US012292270B2

(12) United States Patent
Orlandi

(10) Patent No.: US 12,292,270 B2
(45) Date of Patent: May 6, 2025

(54) SHOTSHELL WITH A BIODEGRADABLE WAD

(71) Applicant: NOBEL SPORT ITALIA S.R.L., Milan (IT)

(72) Inventor: Pierluigi Orlandi, Gaggiano (IT)

(73) Assignee: NOBEL SPORT ITALIA S.R.L., Milan (IT)

( * ) Notice: Subject to any disclaimer, the term of this patent is extended or adjusted under 35 U.S.C. 154(b) by 5 days.

(21) Appl. No.: 17/971,971

(22) Filed: Oct. 24, 2022

(65) Prior Publication Data

US 2023/0127727 A1 Apr. 27, 2023

(30) Foreign Application Priority Data

Oct. 25, 2021 (IT) ..... 102021000027299

(51) Int. Cl.
*F42B 7/04* (2006.01)
*F42B 7/08* (2006.01)
*F42B 12/74* (2006.01)

(52) U.S. Cl.
CPC ..... *F42B 7/04* (2013.01); *F42B 7/046* (2013.01); *F42B 7/08* (2013.01); *F42B 12/74* (2013.01)

(58) Field of Classification Search
CPC .... F42B 7/04; F42B 7/08; F42B 7/046; F42B 12/74
USPC ..... 102/449–453, 455, 456, 461
See application file for complete search history.

(56) References Cited

U.S. PATENT DOCUMENTS

| | | | | |
|---|---|---|---|---|
| 3,092,026 | A * | 6/1963 | Williams | F42B 7/06 102/455 |
| 3,157,121 | A * | 11/1964 | Daubenspeck | F42B 7/06 102/466 |
| 3,270,669 | A * | 9/1966 | David | F42B 7/08 102/451 |
| 3,786,753 | A | 1/1974 | Eckstein et al. | |
| 9,528,800 | B2 * | 12/2016 | Havens | F42B 5/03 |
| 10,393,486 | B2 * | 8/2019 | Havens | C08L 67/02 |
| 10,480,914 | B2 * | 11/2019 | Havens | F42B 33/02 |
| 11,181,350 | B2 * | 11/2021 | McDevitt | F42B 7/08 |
| 11,333,471 | B2 * | 5/2022 | Maricaille | F42B 7/08 |

(Continued)

FOREIGN PATENT DOCUMENTS

| | | |
|---|---|---|
| EP | 0775724 A1 | 11/1996 |
| GB | 2172968 A | 10/1986 |

(Continued)

*Primary Examiner* — James S Bergin
(74) *Attorney, Agent, or Firm* — Dickinson Wright PLLC; Andrew D. Dorisio

(57) ABSTRACT

A shotshell including a hull with a metal head, a base wad, a primer and an outer tubular element, a powder housed inside the hull, and a wad housed inside the outer tubular element and above the powder. The wad includes an inner tubular element adapted to contain a plurality of pellets and having a first and a second end, and a side wall, and a sealing element. A side wall of the inner tubular element contacts an inner side wall of the outer tubular element. The sealing element is inside the outer tubular element of the shotshell between the powder and the first end of the inner tubular element and an outer side wall of the sealing element being in contact with the inner side wall of the outer tubular element, and outside the inner tubular element and in contact with the first end of the inner tubular element.

9 Claims, 7 Drawing Sheets

(56) References Cited

U.S. PATENT DOCUMENTS

| | | | | |
|---|---|---|---|---|
| 11,543,219 | B1 | 1/2023 | Schmieg et al. | |
| 11,933,593 | B2 * | 3/2024 | Schmieg | F42B 7/08 |
| 2017/0160062 | A1 | 6/2017 | Havens | |
| 2021/0140747 | A1 | 5/2021 | McDevitt | |
| 2021/0270586 | A1 | 9/2021 | Maricaille | |

FOREIGN PATENT DOCUMENTS

| | | | | | |
|---|---|---|---|---|---|
| GB | 2586909 | A | | 3/2021 | |
| GB | 2628957 | A | * | 10/2024 | F42B 12/82 |
| WO | WO-2021044139 | A1 | * | 3/2021 | F42B 7/08 |

* cited by examiner

SHOTSHELL WITH A BIODEGRADABLE WAD

TECHNICAL FIELD

Object of the present invention is a shotshell according to the pre-characterizing part of the main claim, and a method for constructing said shotshell.

BACKGROUND

The need has long been felt to have shotshells that include wads that do not pollute the environment in which they drop upon being shot out, typically woods, meadows, wetlands, ponds, rivers, or more generally soil and/or fresh or marine waters. To overcome this drawback, shotshells with wads made of materials that degrade for example under the action of atmospheric agents or microorganisms present in the environment are on the market. For example, EP0775724A1 or US2017160062A1 describe shotshells made of biodegradable materials. However, the known shotshells of the aforementioned type are relatively expensive and complicated to produce.

US 2021/270586 discloses a shotshell according to the pre-characterizing part of the main claim; according to the teachings of this document it is crucial for the inner tubular element thereof to provide therein and at the rear portion thereof, a cylindrical wad adapted to isolate the gases developing from the explosion of the powder contained in the shotshell hull from the pellets contained in said inner tubular element above said cylindrical wad, and to transmit these pellets the energy generated by the gases developing from the explosion of the powder contained in the hull. The cylindrical wad has its rear face flush with the end of the rear portion of the inner tubular element. According to a preferred embodiment the rear face of the wad is associated with a cup shaped element comprising a circular rim that extends rearwards in alignment with said sleeve, wherein this cup shaped element reinforces the sealing. Inserting the cylinder wad inside the tubular element is an operation that must be performed with extreme care, and is therefore relatively complicated since this cylindrical wad must be able to isolate the gases developing from the explosion of the powder contained in the shotshell hull. Adding the cup shaped element at the rear face of the wad is a further relatively complicated operation.

The above mentioned operations make it difficult to produce a shotshell using automatic shotshell assembly machines which require simple and easy to build shotshell components; in practice, the assembly consisting of the inner tubular element, the wad inside the inner tubular element and, if present, the cup shaped element provided outside the tubular element, must be made before assembling the various shotshell components and cannot be made using the usual automatic shotshell assembly machines. Since the wad described in US 2021/270586 has to be made before assembling the shotshell, it is in practice a wad similar to the current plastic wads made by moulding, which are usually used in known shotshells.

GB 2 586 909 describes a shotshell according to the pre-characterizing part of the main claim; according to the teachings of this document it is crucial for the inner tubular element of the shotshell to have a lower end thereof which is closed by crimping the end of said inner tubular element. The inner tubular element further comprises herein a separation member that effectively forms a plug at the closed end of said inner tubular element. According to the teachings of this document, the wad of the shotshell is formed by the inner tubular element closed at the bottom and by the separation member provided inside said inner tubular element. The shotshell described in this document is difficult to construct using the usual automatic shotshell assembly machines which require simple and easy to build shotshell components; in practice, the inner tubular element closed at the bottom must be made before assembling the various shotshell components, and likewise the wad consisting of said inner tubular element and the separation member.

SUMMARY

The object of the present invention is to provide a shotshell comprising a biodegradable and/or compostable wad alternative to the known ones and in which the shotshell is simple and quick to construct using automatic shotshell assembly machines.

In the present context, biodegradable or compostable materials refer to the materials that comply with the standard regulations in force in the various countries, for example compliant with the European standard EN 13432, and are materials that dissolve quickly in the chemical elements that compose them thanks to the action of biological agents such as bacteria, plants, animals and other physical components including the sun and the water, in natural environmental conditions, in the soil and/or in fresh and/or marine open water.

These and other objects, which will be evident to the person skilled in the art, are achieved by a shotshell, a wad for said cartridge, and a process for constructing a shotshell according to the characterizing part of the attached claims.

BRIEF DESCRIPTION OF THE DRAWINGS

For a better understanding of the present invention, the following drawings are attached purely by way of not-limiting example, in which.

DETAILED DESCRIPTION

Figure 1A:
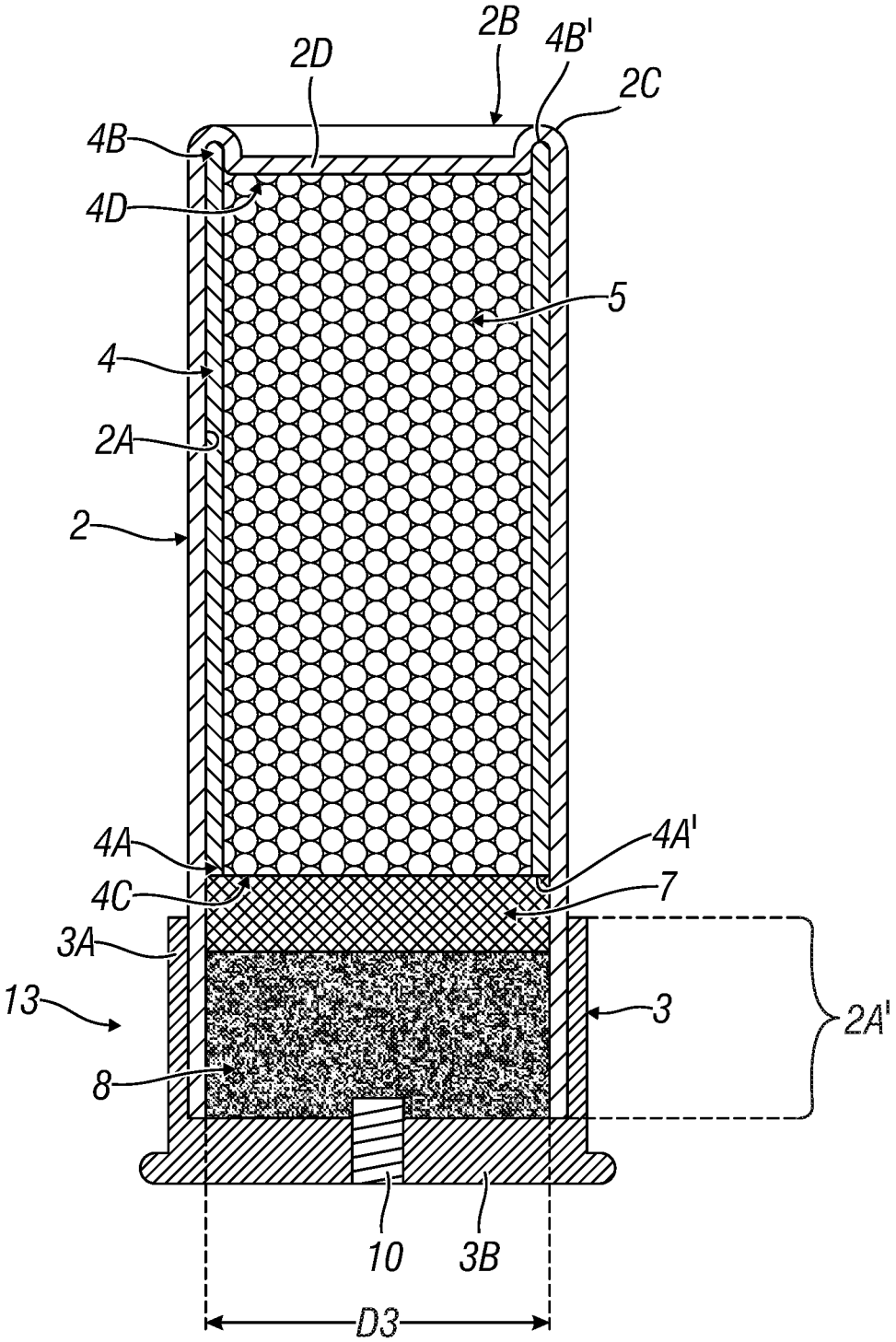
FIGS. 1A and 1B are a schematic and sectional view of a first and a second embodiment of a shotshell according to the invention.
Figure 1B:
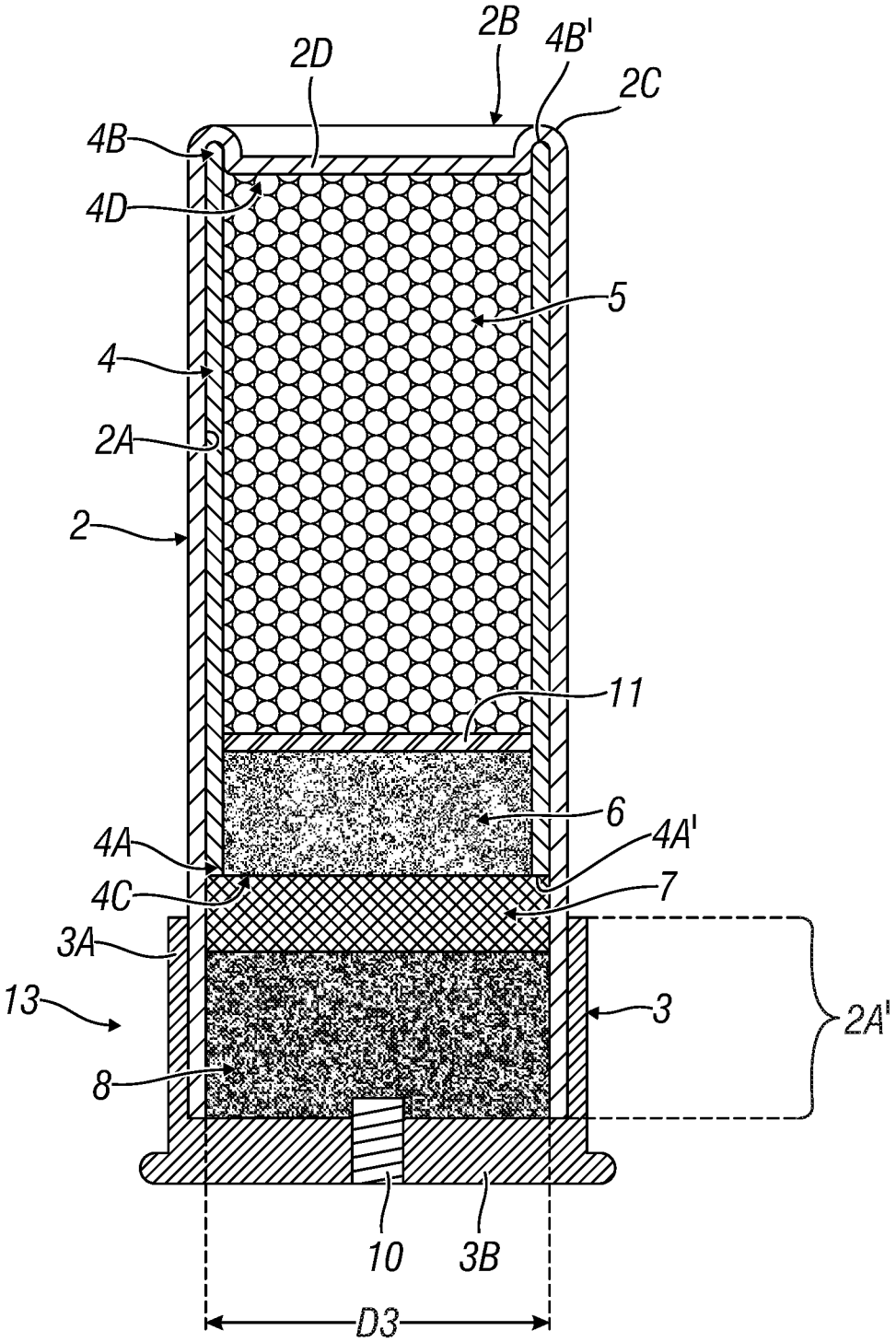

With reference to FIGS. 1A and 1B, they show a shotshell of the type comprising:

- a hull 13 comprising a metal head 3, a base wad 3B, a primer 10 and an outer tubular element 2,
- a powder 8 housed inside the hull 13,
- and a wad 9 housed inside the outer tubular element 1 and above said powder 8.

In the present context, wad refers to a shotshell component which is adapted to perform a plurality of functions:

- it is adapted to contain the pellets and to prevent any contact between the pellets and the inner surface of the firearm barrel, after the powder has exploded, keeping the pellets inside a storage element until they are in the barrel, it is adapted to transmit the pellets the energy generated by the gases developing from the explosion of the powder, it is adapted to at least partially absorb the resisting force exerted by the pellets on a part of the wad at the time of the explosion of the powder and of the phase of pushing the wad into the firearm barrel, and is adapted to isolate the pellets contained in the wad from the gases developing from the explosion of the powder contained in the hull.

The wad 9 comprises:

an inner tubular element 4, open both at the bottom and at the top, adapted to contain a plurality of pellets 5, the lower opening 4C being delimited by a lower edge 4A' of said inner tubular element 4, and the upper opening 4D being delimited by an upper edge 4B' of said inner tubular element 4;

and a sealing element 7, adapted to isolate the gases developing from the explosion of the powder contained in the hull, from the inner tubular element 4 and from what is contained therein, the side wall 4C of the inner tubular element 4 is in contact with an inner side wall 2A of the outer tubular element 2 of the shotshell.

The sealing element 7 is included:

inside the outer tubular element 2 of the shotshell between the powder 8 and the first end 4A of said inner tubular element 4 and an outer side wall 7A of said sealing element 7 being in contact with the inner side wall 2A of said outer tubular element 2, and outside said inner tubular element 4 and in contact with said first end 4A of said inner tubular element 4.

According to the invention, the inner tubular element 4 is not provided with sealing elements therein adapted to isolate the gases developing from the explosion of the powder contained in the hull from the inner tubular element 4 and from what is contained therein, the sealing element 7 adapted to isolate the gases developing from the explosion of the powder contained in the hull being provided in the shotshell only outside said inner tubular element 4.

Again according to the invention, the sealing element 7:

has an upper portion 7C thereof that abuts against the lower edge 4A' of said tubular element 4 and seals it;

and is an element distinct and separate with respect to the inner tubular element.

Thanks to this solution, which does not involves insertion of any sealing element into the tubular element 4 of the wad, nor any processing that involves the closure of a bottom portion of this tubular element, it is possible to simplify the automatic assembly of the cartridges, as the wad is created in an extremely simple way directly in the hull, without having to be preformed before being inserted into the hull. In this way the usual shotshell assembly machines can be used, and it is possible to have extremely fast shotshell production times, and ultimately, to have extremely advantageous shotshell production costs.

The sealing element 7 is also a pushing element, adapted to transmit the energy generated by the gases developing from the explosion of the powder to the inner tubular element 4 and to the pellets contained therein.

Figure 7:
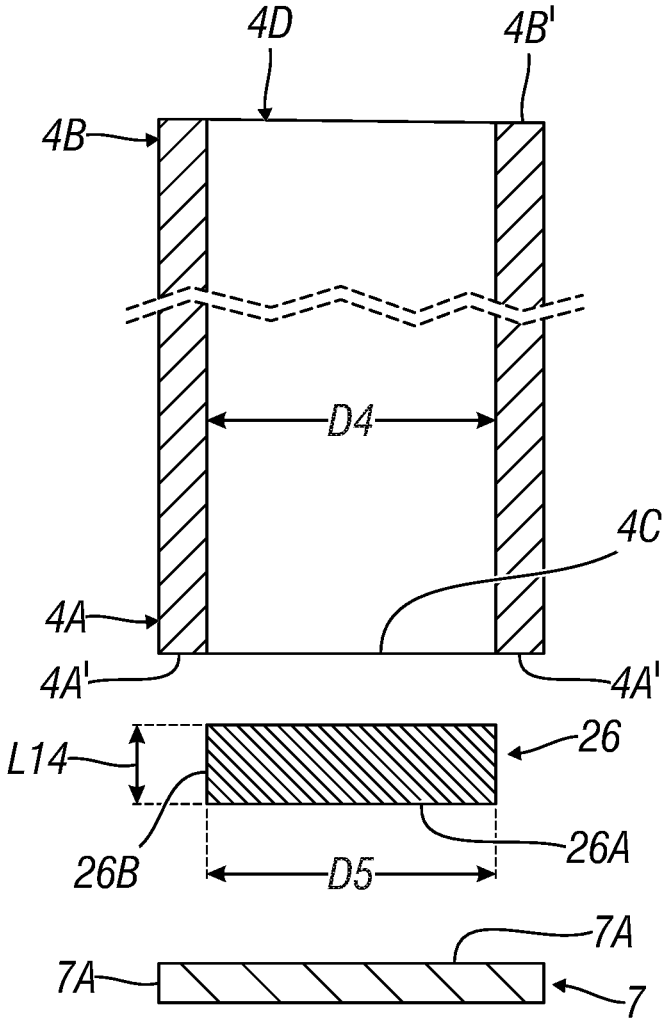
FIGS. 7 and 8 are schematic sectional and exploded views of further components of the shotshell.

According to the invention, the inner tubular element 4 and said sealing element 7 are made at least up to 95% by weight of one or more biodegradable and/or compostable materials, more preferably they are made up to 99% by weight of one or more biodegradable and/or compostable materials. The shotshell can advantageously also comprise an additional element 26, 26' (FIGS. 7 and 8) housed inside the inner tubular element 4 in a lower portion 4F thereof which extends from the lower opening 4C towards the upper opening 4D, and below the plurality of pellets 5. This additional element is adapted to stiffen the lower portion 4F of the inner tubular element 4 and/or to at least partially absorb the resisting force generated by said plurality of pellets 5 at the time of the explosion of the powder and of the phase of pushing the wad 9. The additional element 26 is dimensioned, and/or has a shape, and/or is made of a material, in such a way that said additional element does not create a seal with said inner tubular element 4, that is in such a way that said additional element is not adapted to create a seal and isolate the inner tubular element 4 from the gases developing from the explosion of the powder contained in the hull when contained in the inner tubular element above the additional element, which function is performed only by the sealing element 7 outside the inner tubular element 4.

To prevent the additional element 26 from creating a seal, for example the outer surface 26B, 26B' thereof could include one or more longitudinal grooves and/or the body of the additional element could have one or more longitudinal through holes, and/or the additional element could have a diameter D5, D5' slightly less than the internal diameter D4 of the inner tubular element 4, so that it can be also easy to insert inside the tubular element, at the time of assembling the wad in the shotshell. The additional element could also be made of a usual material permeable to the gases developing due to the explosion of the powder.

At the time of the explosion of the powder, the pellets exert a resisting force that is concentrated above all in the lower part of the tubular element 4. This tubular element, however, must not break while travelling through the firearm barrel and must always house the pellets therein in such a way that they do not come into contact with the internal surface of the firearm barrel and damage it. The additional element 26, 26' is adapted to strengthen the lower part of the tubular element, so as to ensure that it does not break due to the resistant force of the pellets.

The additional element is also adapted to at least partially absorb the resisting force generated by the plurality of the pellets 5 at the time of the explosion of the powder and of the phase of pushing the wad 9. It should be noted that in the absence of this additional element and when the pellets are in contact with the upper face of the sealing element 7 it is this sealing element that also has the function of at least partially absorbing the resisting force of the pellets.

Advantageously, the additional element 26 is an element distinct and separate with respect to the sealing element 7, a lower surface 26A thereof (FIG. 7) being in contact with an upper surface 7A of the sealing element 7, when the cartridge is assembled. The additional element can be made in one or more parts, even distinct but in contact with each other and/or in different materials.

Figure 8:
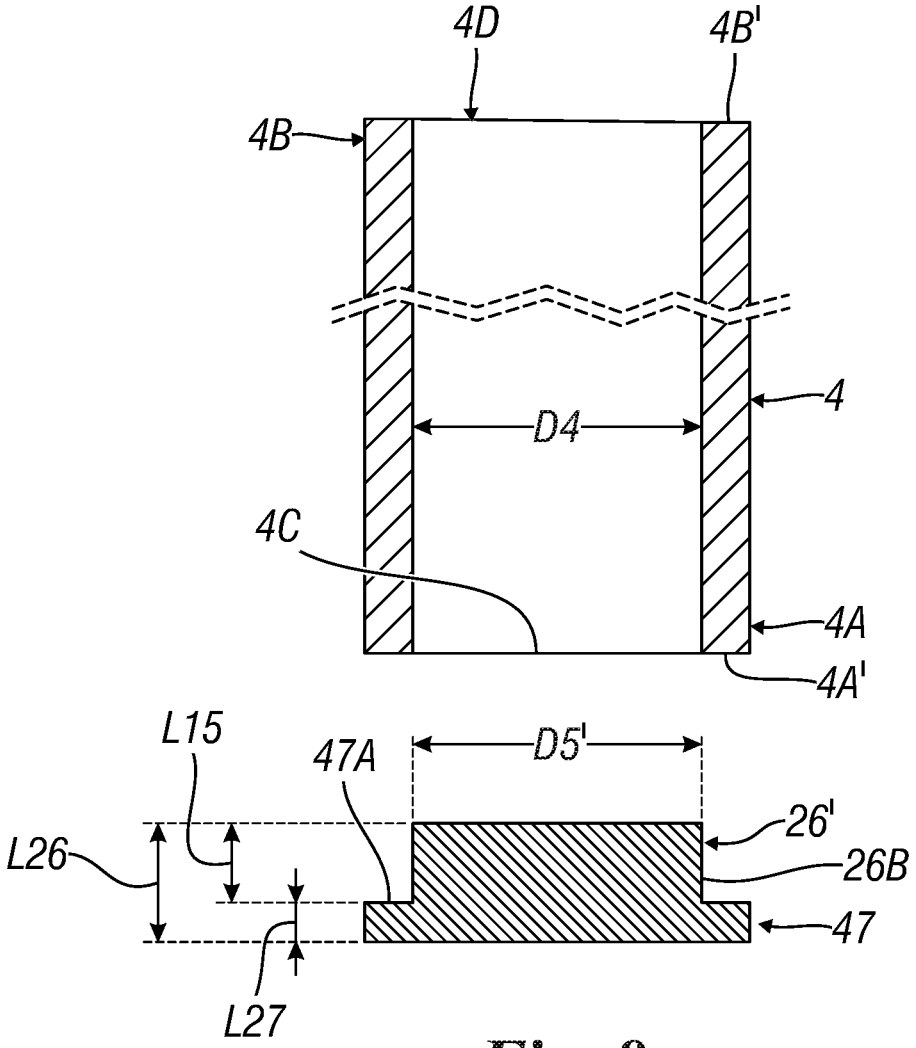

However, the additional element can also be in one piece with the sealing element 7, as shown in FIG. 8, in which case it departs from an upper surface 47A thereof, abutting the lower edge 4A' of the inner tubular element 4.

Figure 6:
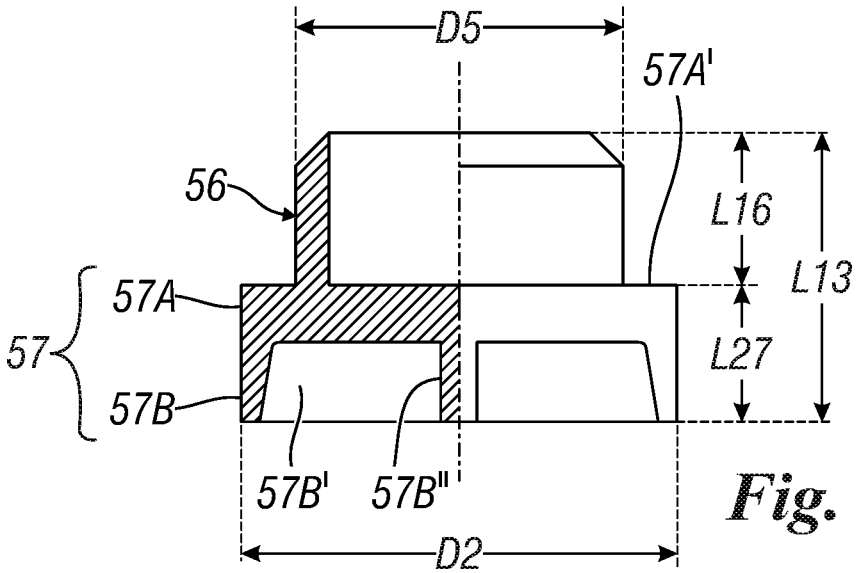

FIG. 6 is a particular embodiment of a sealing element 57 with the additional element 56 also in one piece. The sealing element 57 includes:

a cup-shaped lower part 57B having a recessed part 57B' facing the powder 3, and adapted to open outwards when the powder explodes, so as to increase the seal of the element 57, and an upper part 57A which is preferably solid and less deformable than the lower part 57B, which is adapted to exert a pushing force on the inner tubular element 4, the lower edge 4A' of which rests on the upper surface 57A'. An annular wall 56 also departs from this surface which forms the previously described additional element and is adapted to fit inside the lower portion of the inner tubular element 4, so as to stiffen it, but not also to seal it, having a diameter D5 which is slightly less (for example a few microns less) than the internal diameter D4 of the tubular element 4. On the other hand, since the lower part 57B has to create a seal, it has a diameter D2 equal to the internal diameter D3 of the outer tubular element 4 and, in any case, because of its being cup-shaped and made of a material that is at least partially deformable, it is adapted to increase this diameter when the powder explodes, so as to ensure optimal sealing. Advantageously, one or more stiffening walls 57B" are also provided in the cavity 57B'.

According to a preferred embodiment, the inner tubular element 4 contains therein a filling element 6 adapted to limit the quantity of the pellets contained inside the inner tubular element 4, but not also to create a seal, since it not adapted to isolate the gases developing from the explosion of the powder contained in the hull, from the inner tubular element 4 and from what is contained therein, said sealing function being performed only by said sealing element 7 outside the inner tubular element 4. It should be noted that the filling element could be provided, as usual for the person skilled in the art, also in other positions, in the wad, for example in the upper part of the tubular element 4, above the pellets and/or mixed to the pellets.

Advantageously, the filling element 6 is provided at the lower portion 4F of the inner tubular element, in this case the filling element and the additional element 6 can form a single element, adapted to both limit the quantity of the pellets contained inside the inner tubular element 4, and to stiffen said lower portion 4F of the inner tubular element 4 and/or to at least partially absorb the resisting force generated by said plurality of pellets 5 at the time of the explosion and of the phase of pushing the wad 9, but not also to create a seal with said inner tubular element 4, that is to isolate the inner tubular element 4 from the gases developing from the explosion of the powder contained in the hull from the inner tubular element 4 and from what is contained therein, the sealing element 7 adapted to isolate the gases developing from the explosion of the powder contained in the hull, said sealing function being performed only by said sealing element 7 outside the inner tubular element 4. Advantageously, the additional element 26, 26', 56, and/or the filling element 6 have a height L14-L16, L4 between 1 mm and 10 mm, more preferably between 1 mm and 5 mm.

Advantageously, the sealing element 7, 17, 27, 37, 47, 57 has a height L3, L23, L24, L25, L26, L27 greater than 1 mm, preferably at least 3 mm, and even more preferably the height is between 3 mm and 8 mm.

Advantageously, when an upper face 7A of the sealing element 7 is in direct contact with the plurality of pellets 5 (FIG. 1A) said sealing element is also adapted to at least partially absorb the resisting force generated by said plurality of pellets 5 at the time of the explosion of the powder and of the phase of pushing the wad 9.

According to a preferred embodiment of the invention, the inner tubular element 4 and the sealing element are connected to each other and to the outer tubular element 2 only by interference with the inner wall 2A of said outer tubular element 2, this makes assembling shotshell simpler and faster, and allows to construct the wad directly in the hull.

According to a preferred embodiment of the invention, the filling element 6 consists of a loose powder or granules or fibre material, wherein the components of said loose material are not bound together to form a single body.

More particularly, the hull 13 is of the usual type for the person skilled in the art, therefore its components: the metal head 3, the base wad 3B, the primer 10 and the outer tubular element 2, are all components of the usual type for the person skilled in the art which will not be described in detail below. The hull 13 in the assembly of a shotshell is generally a separate component, which includes all its pre-assembled components.

The metal head 3 of the hull 13 is preferably made of a usual metal material, and comprises a tubular wall 3A and a base wad 3B, which has a central through hole for housing the primer 10. The outer tubular element 2 is also made of a usual material, for example of a plastic material, and preferably provides a closing second upper end portion 2B thereof (FIG. 1). As conventional for the person skilled in the art, the shotshell can include for example a blankstar closure, in which, when the shotshell is assembled, the upper end 2B of the tubular element 2 is folded into folds 2D and riveted with a special caulking creating an upper edge 2C. The shotshell, as conventional for the person skilled in the art, could also include a round hem closure and an upper closing disc, which will not be described in detail below.

The inner tubular element 4 is in the shape of a tube having a constant circular section, with a lower end 4A and an upper end 4B, and is made at least up to 95% by weight of one or more biodegradable and/or compostable materials of the usual type for the person skilled in the art, more preferably it is made up to 99% by weight of one or more biodegradable and/or compostable materials, for example from plant fibres, for example linen or cotton, and/or animal fibres, for example animal hair, and/or cellulose-based materials, for example paper or cardboard, and/or natural plant and/or mineral granular or powder materials, for example wood sawdust or cork or sand.

According to a preferred embodiment, the inner tubular element 4 comprises one or more of the following materials: felt made of natural and/or animal fibres, and/or paper and/or cardboard, and/or fibres and/or granules and/or wood dust, and/or fibres and/or granules and/or cork powder, granules and/or powder of mineral substances.

Preferably the inner tubular element 4 is made of wrapped or spiral cardboard, biodegradable or compostable plastics.

It should be noted that the cardboard is preferably of the hydrophilic type so that it can absorb environmental moisture from the environment in which it falls, and is therefore rapidly biodegraded by the microorganisms usual for cellulose.

The thickness S1 of the tubular element 4 is for example between 0.5 mm and 2 mm, more preferably between 1.3 mm and 1.4 mm and even more preferably equal to about 1.35 mm.

The thickness of the tubular element must in any case be such as to ensure that the tubular element does not break due to the action of the pellets contained therein, so that these pellets cannot come into contact with the internal surface of the firearm barrel and therefore cannot damage it.

The external diameter D1 of the inner tubular element 4 is related to that of the shotshell and more specifically to the inner diameter D3 of the outer tubular element 2, advantageously these two diameters D1 and D3 are substantially equal, so that the outer wall 4G of the inner tubular element 4 can slide along the inner wall 2A of the inner tubular element 2 during the assembly of the shotshell so as to insert the two tubular elements one into the other and the inner element 4 remains in the desired position by friction with the outer element 2. For example, the inner tubular element 4 can have an internal diameter D4 equal to 17.4, a thickness S1 equal to 0.6 mm (+/−0.1 mm), and an external diameter D1 equal to 18.6 mm (+/−0.1 mm) adapted to be inserted into the outer tubular element 2 of a usual 12 gauge shotshell, which has an internal diameter D3 equal to 18.6 mm (+/−0.1 mm).

The inner tubular element 4 can also include a plurality of through slits 4H which depart from the upper edge 4B and extend for a length L1 between 30% and 100% of the length L2 of the chamber 4E which contains the pellets. Preferably the slits 4H are equidistant from each other. The slits 4H allow the opening of the inner tubular element 4 when it has been ejected from the firearm and help the formation of a desired distribution of the pellets in the air. According to the invention, the sealing element is provided only outside the inner tubular element 4, in order to simplify and make it possible to assemble the wad directly during the shotshell loading phase and by means of usual automatic shotshell assembly machines, which require simple and easy-to-build shotshell components.

The wad of the shotshell according to the invention is in fact made up of the sealing element 7 and the inner tubular element 4 which are separate and distinct elements and which abut each other without having to penetrate each other in a sealed manner. Therefore, the wad does not need to be pre-assembled and is at the same time made with simple-shaped components, a tube and a disc, which do not require preliminary operations to give them a particular shape.

According to the invention, the element 7 in addition to creating a seal, that is isolating the gases developing from the explosion of the powder contained in the hull from the inner tubular element 4 and from what is contained therein, is also adapted to effectively transmit the energy generated by said gases to the inner tubular element 4 and to the pellets contained therein, ensuring, together with the inner tubular element 4, a push regular and without the pellets energy losses.

Figure 2A:
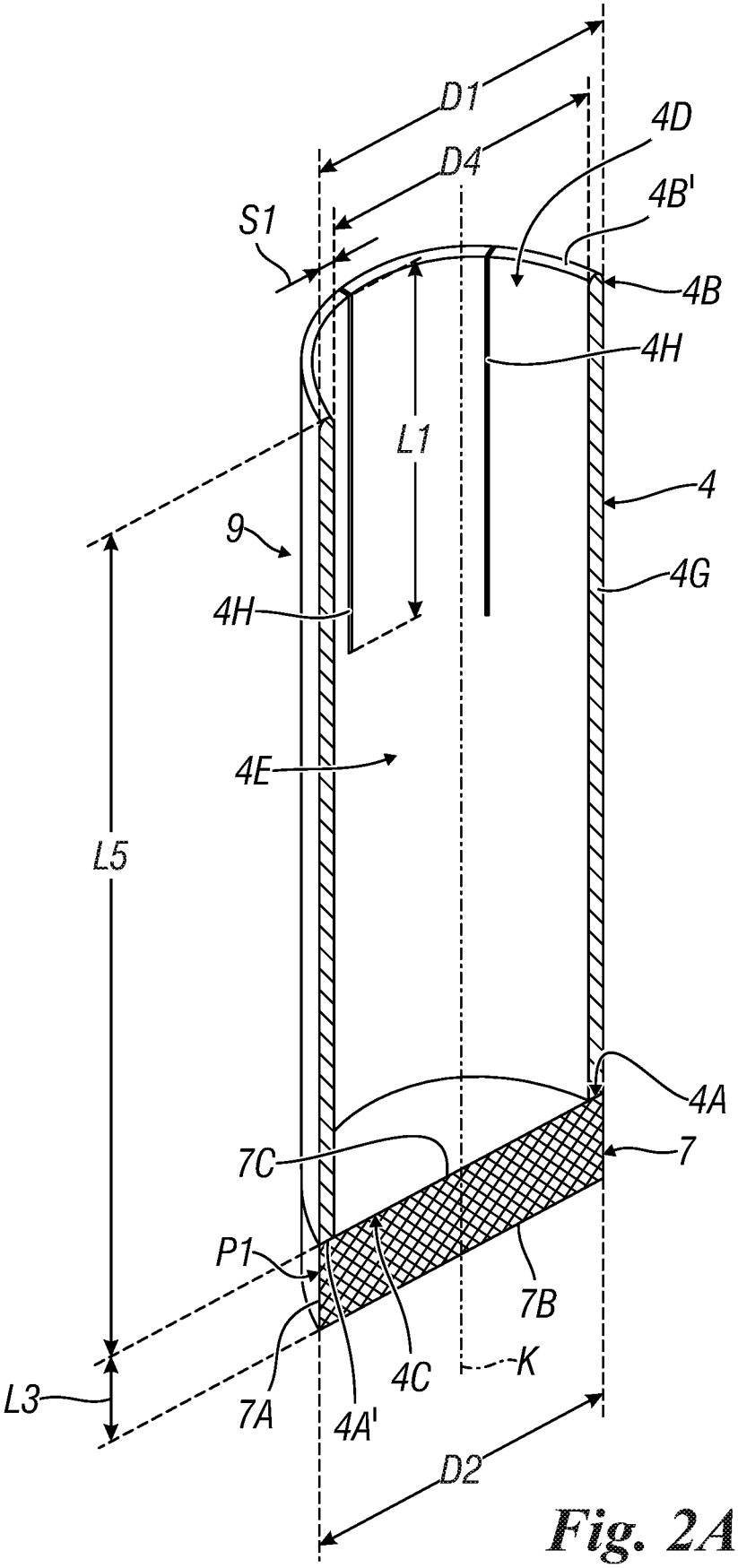
FIGS. 2A and 2B are a schematic view in section and on an enlarged scale with respect to that of FIGS. 1A, and 1B of the inner part of the shotshells of FIGS. 1A, and 1B.
Figure 2B:
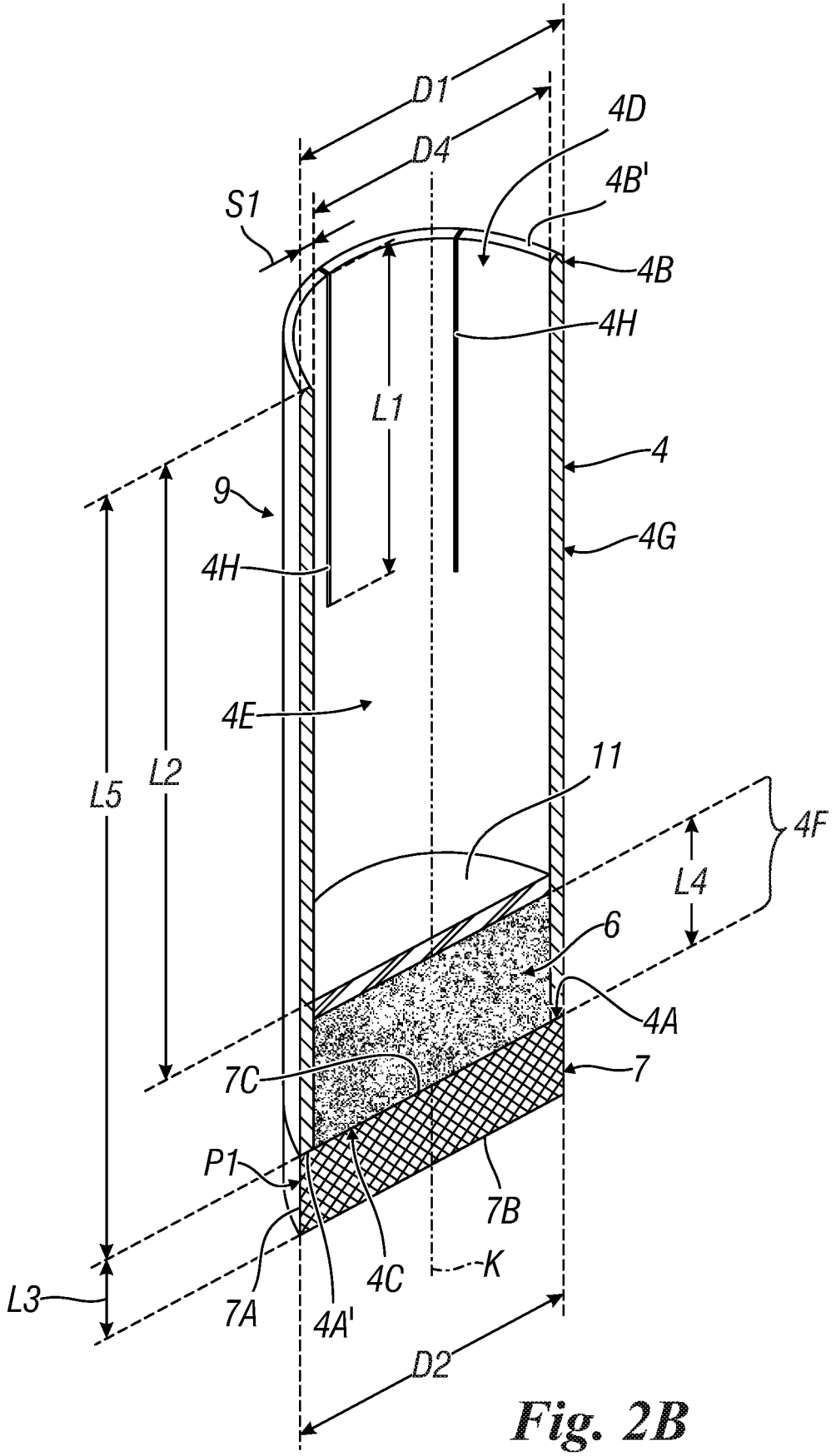

To this end, according to the invention, the sealing element is made at least up 95% by weight of one or more biodegradable and/or compostable materials, preferably in paper, and has a thickness L3 (FIG. 2) of at least 3 mm; for example the thickness L3 is between 3 mm and 25 mm more preferably it is between 3 mm and 8 mm. However, the sealing element could also have a thickness less than 3 mm if made of a biodegradable and/or compostable plastic material. The sealing element 7, 17 preferably has a circular cross-section, and has a longitudinally symmetrical shape; in the present context by longitudinally symmetrical shape it is meant that the sealing element 7, 17 has the same shape both in a first position P1 (FIG. 2A) and in a second position rotated by 180° with respect to the first, so that it does not need to be oriented when inserted into the outer tubular element 2 of the shotshell for the construction of the same. For example, the sealing element 7 has a regular cylindrical shape with a side wall 7A and opposite upper and lower flat walls 7B and 7C, and is a solid body.

Figure 3:
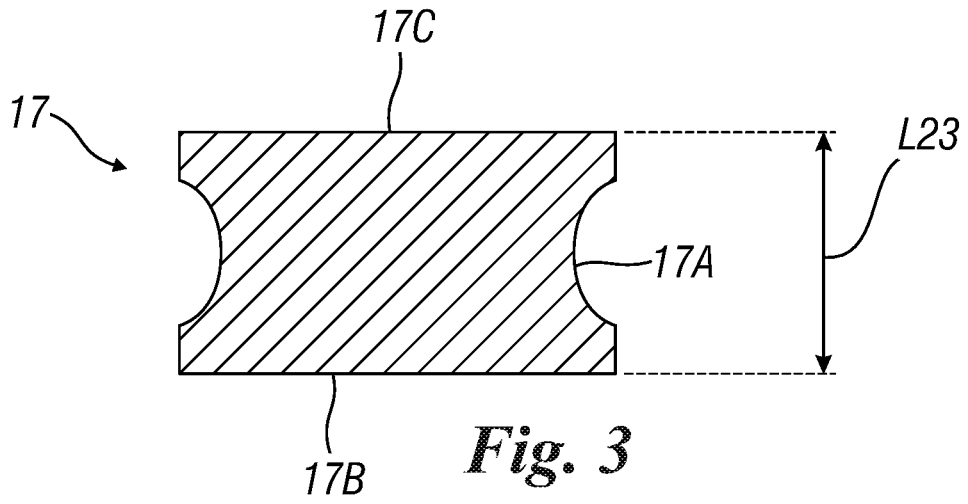
FIGS. 3, 4, 5, 6 are a schematic sectional view of four variants of a component of the shotshell.

The walls 7C and 7B could, however, also have a different shape, for example a concave or convex shape, but equal for both walls, and/or the two walls 7C and 7B could be connected together by a body having a non-vertical, but for example concave side wall 7C. In FIG. 3, for example, a variant of the sealing element indicated as a whole with the reference 17 is shown, which includes a concave side wall 17A and upper and lower flat walls 17B, 17C. The shape of the sealing element could also be more complex (such as that of FIG. 6, previously described) and include for example upper and lower walls identical to each other and preferably flat, connected to each other by an intermediate part having shape and/or dimensions other than those of said upper and lower walls.

Preferably, the external diameter D2 of the sealing element 7 is equal to the external diameter of the inner tubular element 4 and is also substantially equal to the internal diameter D3 of the outer tubular element 2, so that the side wall 7A of the seal is substantially in contact with the corresponding portion of the inner wall 2A of the outer tubular element 2, and so that the outer wall 7A of the sealing element 7 can slide along the inner wall 2A of the inner tubular element 2 during assembly of the shotshell so as to insert the two elements one into the other and so that the sealing element remains in the desired position by friction with the outer tubular element 2. The sealing element 7 is provided outside the inner tubular element 4 and the lower free edge 4A of this inner tubular element 4 abutting against the upper flat wall 7C of the sealing element 7. Thanks to this position, the sealing element 7 is adapted to isolate the gases developing from the explosion of the powder contained in the hull, from the inner tubular element 4 and from what is contained therein, and is also adapted to effectively transmit the energy generated by said gases to the inner tubular element 4 and to the pellets contained therein, ensuring, together with the inner tubular element 4, a push regular and without the pellets energy losses.

For example, the external diameter D2 of the sealing element 7 is equal to 18.6 mm (+/−0.1 mm) adapted to be inserted into the outer tubular element 2 of a usual 12 gauge shotshell, which has an internal diameter D3 equal to 18.6 mm (+/−0.1 mm).

The sealing element, as well as the additional element, if present, and the filling element, if present, are made at least up 95%, and more preferably 99%, of biodegradable and/or compostable materials, for example from plant fibres, for example linen or cotton, and/or animal fibres, for example animal hair, and/or cellulose-based materials, for example paper or cardboard, and/or natural plant and/or mineral granular or powder materials, for example wood sawdust or cork or sand. These materials can be used alone or in combination with each other; in case of non-compact materials and/or multi-materials and/or layered materials, the materials can be stably fixed together using a binder or an adhesive substance, preferably a binder or a biodegradable adhesive substance, which represents a percentage by weight between 1% and 5% of the sealing element 7. For example the binder can be a usual substance of plant and/or animal origin such as vegetable gums, starches, latex, vegetable resins or the like.

Preferably the sealing element and/or the additional element, if present, is obtained by die-cutting or other type of cutting starting from a block of material from which to obtain a plurality of these sealing elements.

According to a first preferred embodiment, the sealing element 7 as well as the additional element, if present, are made of pressed paper greased with vegetable waxes.

According to a further embodiment of the invention, the sealing element and/or the additional element, if present, are formed by at least two overlapping parts 27A, 27B (FIG. 4) and preferably made of two different materials. The overall thickness L3 of the two parts is, for example, as for the previously described sealing element 7, between 3 mm and 25 mm, more preferably between 3 mm and 8 mm.

By constructing the sealing element in at least two parts, it is possible to make:

the lower part 27B, that is the one which is closest to and in contact with the powder, with an optimal material and/or characteristics to guarantee an effective seal, that is an effective isolation of the gases produced by the explosion of the powder, and the upper part 27A, that is the one which is closest to and in contact with the lower end 4A of the inner tubular element 4, with an optimal material and/or characteristics to ensure an effective resistance with respect to the action that the pellets contained in the inner tubular element 1 exert on the upper face of the upper part 27B at the time of the explosion of the powder, especially when the filling element 6 is not present in the inner tubular element 4.

In the light of the above, the lower part 27B is preferably made in such a way as to deform to a greater extent (for example it deforms by more than 10%/30%) than the upper part when the powder explodes. For this purpose, for example, the lower part 17B is made of a material that deforms to a greater extent than the material with which the upper part 27A is made, and/or the thickness L7 of the lower part 27B is less, compared to the thickness L8 of the upper part, and/or the materials with which the two parts are made are different. As previously described, this greater deformation can also be obtained by giving a particular shape, for example a cup shape, to the lower part.

Figure 4:
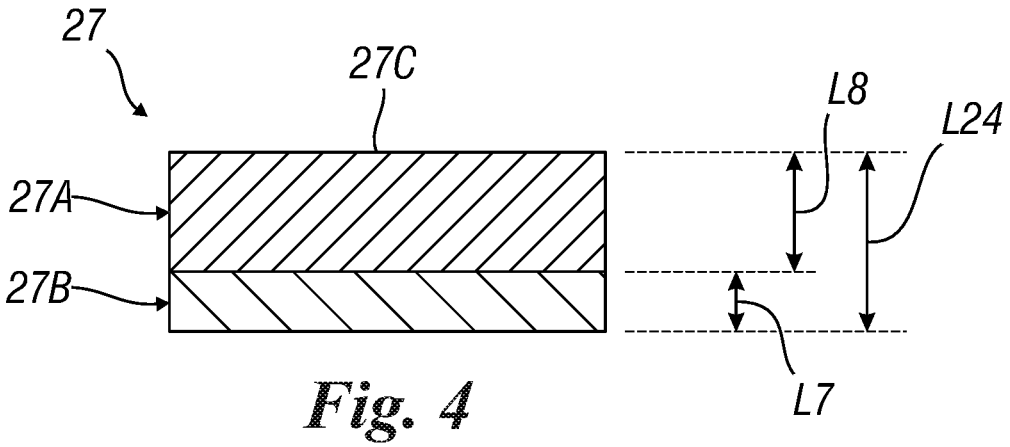
Figure 5:
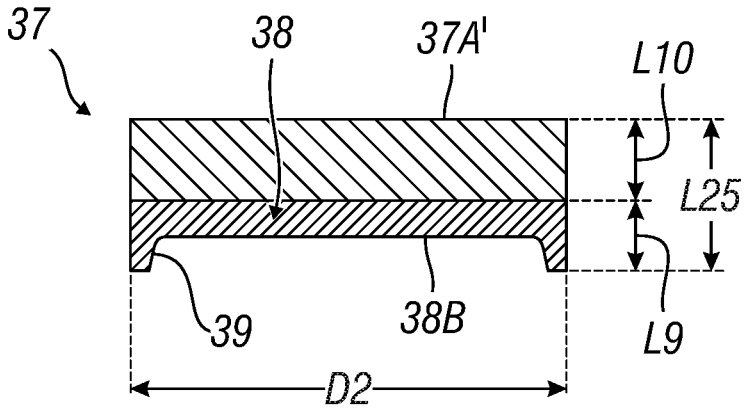

As shown in FIG. 4, the shape of the two parts 27A, 27B can be the same, for example the two parts can have the shape of two discs having the same or different thickness.

All the wad 9 materials, with the exception of the pellets 5, must be at least 95% by weight of one or more biodegradable and/or compostable materials, more preferably they consist up to 99% by weight of one or more biodegradable and/or compostable materials. These materials are of the same type described above for the sealing element 7.

According to the invention, the sealing element 7, 17, 27, 37, 47, 57 is always an element distinct and separate from the other shotshell components; this simplifies and facilitates and speeds up the production of the wad which can be constructed directly during the hull filling phase.

The filling element 6 consists of a material in powder or granules or in biodegradable and/or compostable fibres.

Preferably the height L4 of the filling element is between 0% and 50% of the total height L5 of the inner tubular element 4, more preferably it is between 10% and 30%.

Preferably, the filling element is in contact with the inner wall of the inner tubular element 4 and closes the inner tubular element 4 at the bottom, having, however, only the function of allowing a predefined amount of pellets, the function of closing the filling element 6 is not essential. The filling element 6 is preferably housed in a chamber delimited at the bottom by the upper wall 7C of the sealing element 7, laterally by the inner wall of the lower portion 4F of the inner tubular element 4 and above by a separation element 11, for example having a disc shape (as shown in the figures, or even directly by a lower layer of pellets). Thus, preferably, the filling element is provided in a chamber of the inner tubular element 4, which is separated from the one that contains the pellets. This facilitates the assembly of the shotshell.

According to a variant not shown, the filling element could also be mixed with the pellets and/or provided in the inner tubular element 4 without the separation disc 11 therefore, at least partially in contact with the pellets, and/or provided in the upper part of the tubular element above the pellets.

The filling element consists of at least 95%, more preferably 99%, of biodegradable and/or compostable materials, for example from plant fibres, for example linen or cotton, and/or animal fibres, for example animal hair, and/or cellulose-based materials, for example paper or cardboard, and/or natural plant and/or mineral granular materials or powders, for example wood sawdust, or cork, or sand.

These materials can be used alone or in combination with each other, and do not need to be stably bound together by means of a binder and/or an adhesive to form a single body.

For example, the filling element is made with cork granules having dimensions between 0.1 mm and 5 mm not bound together. The use of cork is advantageous due to its nature as a natural material.

The separation element 11 also consists of at least up to 95%, more preferably 99%, biodegradable and/or compostable materials, for example it is a cardboard disc. However, the disc could also be made of one of the materials listed for the sealing element 7.

According to a variant not shown, the filling element 7 can also be made at least up to 95%, more preferably 99%, from the biodegradable and/or compostable materials listed above, not loose but forming a single body.

The filling element can, therefore, be formed as a single, possibly multi-material and/or multi-layer body which forms a single piece of a solid material. The solid material this filling element can be made of can be one or more of those indicated for the construction of the sealing element 7. This material, therefore, consists of at least 95%, more preferably 99%, biodegradable and/or compostable materials, for example plant fibres, for example linen or cotton, or animal fibres, for example animal hair, or cellulose-based materials, for example paper or cardboard, or natural granular materials, for example sawdust wood or cork.

It should be noted that the filling element, even if formed as a single body, has in any case only the function of reducing the volume of the chamber 4E defined by the inner tubular element 4, so as to be able to regulate the quantity of the pellets to be housed in the shotshell, and does not have the function of sealing and isolating the inner tubular element 4 from the gases developing from the explosion of the powder contained in the hull, this function being performed by the sealing element 7. It is therefore not essential for the single body of the filling element to have a side wall in continuous contact with the inner wall of the inner tubular element 4, but the filling element can also be spaced from this inner wall, preferably by a portion less than the diameter of the pellets. It is also not essential for the single body of the filling element to be a solid body; it could for example provide a plurality of longitudinal through holes, preferably having a diameter less than that of the pellets, so as to lighten the weight of the filling element and also help biodegradability.

The pellets 5 are of the type usual for the person skilled in the art.

The method for assembling a shotshell according to the invention includes:

a) preparing at least the following distinct and separate components of the shotshell: the hull 13, the powder 8, the sealing element 7, the inner tubular element 4 open at both the ends thereof, the pellets 5;

b) initially inserting the powder 8 from the upper opening of the outer tubular element 2 of the hull 13;

c) then inserting from the upper opening of the outer tubular element 2 of the hull 13 the sealing element 7, which is pushed against the powder 8 and at least one cylindrical portion of the outer side wall 7A being in contact with a corresponding cylindrical portion of the inner side wall 2A of said outer tubular element 2, d) then inserting the inner tubular element 4, with both ends thereof open, from the upper opening of the outer tubular element 2 of the hull 13;

e) then inserting at least one predefined quantity of pellets 5 from the upper opening of the inner tubular element 4;

f) then closing the shotshell.

The method according to the invention includes the construction of the wad just during the construction of the shotshell by connecting together, inside said outer tubular element 2, at least said sealing element 7 and said inner tubular element 4.

The method according to the invention includes inserting the sealing element 7 and the inner tubular element 4 of the wad in the outer tubular element 2 of the hull 13, so that the inner tubular element 4 is without sealing elements therein, the sealing element 7 adapted to isolate the gases developing from the explosion of the powder contained in the hull being provided in the shotshell only outside said inner tubular element 4; said sealing function being performed only by said sealing element 7 outside the inner tubular element 4.

The method according to the invention includes inserting only said sealing element 7 in the shotshell, as a component adapted for sealing, which always remains outside said inner tubular element 4, and so that at least one portion of the upper face 7A of the sealing element 7 comes into contact with a lower edge 4A' of said inner tubular element 4.

The method according to the invention provides that the sealing function is performed only by the contact: of at least one portion of an outer wall of the sealing element with a corresponding portion of the inner wall of the outer tubular element 2, and by the contact of at least one portion of the upper face 7A of the sealing element 7 with a lower edge 4A' of said inner tubular element 4.

Preferably, the method according to the invention also provides inserting an additional element 26, 26', 56 inside the inner tubular element 4 in a lower portion 4F of said inner tubular element 4 which extends from the lower opening 4C towards the upper opening 4D, said additional element being provided below the plurality of pellets 5 and said additional element being adapted to: stiffen said lower portion 4F of the inner tubular element 4 and/or to at least partially absorb the resisting force generated by said plurality of pellets 5 at the time of the explosion of the powder and of the phase of pushing the wad 9, but not also to create a seal with said inner tubular element 4, that is with said additional element which is not adapted to isolate the inner tubular element 4 from the gases developing from the explosion of the powder contained in the hull, from the inner tubular element 4 and from what is contains therein, said sealing action being performed only by said sealing element 7 outside the inner tubular element 4.

Thanks to the fact that the inner tubular element 4 and the sealing element 7 are distinct and separate elements and are connected to each other and to the outer tubular element 2 only by interference with the respective inner wall of the component in which they are inserted there are two advantages.

The first advantage is due to the enhanced biodegradability of these components. In fact, because they are distinct and separate from each other, these components disperse in the environment separately from each other when a shotshell is fired and this makes the biodegradability process easier compared to other solutions in which these components are bound together, for example by means of binders or adhesives. In particular, it has been verified that the sealing element 7, after the ejection from the firearm, separates from the inner tubular element 4 and the filling element 6 also protrudes from the inner tubular element 4 and the latter therefore drops in the environment separated from the filling and/or the sealing element. The fact that these components are found in the environment separated from each other makes biodegradability and/or compostability easier because the dimensions and/or thicknesses and/or mass of these individual components is less than the mass of the components joined together.

The shotshell assembly process is also simplified and speeded up by the fact that the wad 9 components are all separated from each other, as it is not necessary to provide for a production phase that involves a pre-assembly of the wad components and subsequently the insertion of this pre-assembled wad inside the outer tubular element. The wad, according to the invention, is assembled directly during the production of the shotshell. In this way, by using the usual shotshell loading machines it is also possible to make the wad, facilitating, simplifying, and thus speeding up the shotshell production process.

Ultimately, the invention simplifies the shotshell production since, compared to known solutions, it is not necessary to pre-assemble a wad which is then inserted into the hull, but the wad is made by simply inserting the various components thereof into the hull during its loading. Furthermore, the extremely simple shape of the various wad components allows to use the usual automatic shotshell assembly machines and to have extremely rapid shotshell production times.

The invention claimed is:

1. A shotshell comprising:

a plurality of pellets;

a hull comprising a metal head, a base wad, a primer and an outer tubular element, a powder housed inside the hull, and a wad housed inside the outer tubular element and above said powder, wherein said wad comprises:

an inner tubular element open both at the bottom and at the top, adapted to contain the plurality of pellets, the lower opening being delimited by a lower edge of said inner tubular element, and the upper opening being delimited by an upper edge of said inner tubular element wherein all of the plurality of pellets are contained inside the inner tubular element;

and at least one sealing element adapted to:

isolate the gases developing from the explosion of the powder contained in the hull, from the inner tubular element and from what is contained therein, wherein a side wall of the inner tubular element is in contact with an inner side wall of said outer tubular element;

wherein the sealing element is provided:

inside the outer tubular element of the shotshell between the powder and a first end of said inner tubular element and an outer side wall of said sealing element being in contact with an inner side wall of said outer tubular element, and outside said inner tubular element and in contact with said first end of said inner tubular element, wherein:

the inner tubular element does not have sealing elements therein adapted to isolate the gases developing from the explosion of the powder contained in the hull, from the inner tubular element and from what is contained therein, the sealing element adapted to isolate the gases developing from the explosion of the powder contained in the hull, being provided in the shotshell only outside said inner tubular element;

wherein said sealing element has an upper portion thereof that abuts against the lower edge of said tubular element;

wherein said sealing element is an element distinct and separate with respect to the inner tubular element;

wherein said sealing element is also a pushing element, adapted to transmit the energy generated by the gases developing from the explosion of the powder to the inner tubular element and to what is contained therein, and wherein at least the inner tubular element and said sealing element are made at least up to 95% by weight of one or more biodegradable or compostable materials;

wherein the shotshell further comprises an additional element housed inside the inner tubular element in a lower portion thereof which extends from the lower opening towards the upper opening, and below the plurality of pellets, wherein said additional element is adapted to stiffen said lower portion of the inner tubular element or to at least partially absorb the resisting force generated by said plurality of pellets at the time of the explosion of the powder and of the phase of pushing the wad, wherein said additional element is dimensioned, or has a shape, or is made of a material adapted not to create a seal with said inner tubular element, that is said additional element is not adapted to create a seal and isolate the inner tubular element from the gases developing from the explosion of the powder contained in the hull from the inner tubular element and from what contained therein, said sealing action being performed only by said sealing element outside the inner tubular element;

wherein the sealing element has a continuous upper flat surface in contact with a flat lower end of the inner tubular element; and wherein the inner tubular element is connected to the outer tubular element by an interference fit and the sealing element is connected to the outer tubular element by an interference fit.

2. The shotshell according to claim 1, wherein the additional element is an element distinct and separate with respect to the sealing element, and in that a lower surface of said additional element is in contact with an upper surface of said sealing element, or in that the additional element is in one piece with the sealing element and departs from an upper surface thereof.

3. The shotshell according to claim 1, wherein the additional element has a height between 1 mm and 10 mm.

4. The shotshell according to claim 1, wherein the sealing element has a height greater than 1 mm.

5. The shotshell according to claim 1, wherein an upper face of said sealing element is in direct contact with the plurality of pellets and in that the sealing element is also adapted to at least partially absorb the resisting force generated by said plurality of pellets at the time of the explosion of the powder and of the phase of pushing the wad.

6. The shotshell according to claim 1, wherein:

the biodegradable or compostable materials comprise one or more of the following materials: plant fibres, linen or cotton, animal fibres, animal hair, cellulose-based materials, paper or cardboard, natural plant or mineral granular or powder materials, sawdust or cork or sand;

or in that said materials are used alone or in combination with each other, or in that in case of non-compact materials or multi-materials or layered materials, the materials are stably fixed together using a binder or an adhesive substance which represents a percentage by weight between 1% and 5%.

7. The shotshell according to claim 1, wherein the sealing element is formed by at least two overlapping parts and in which:

the lower part is made of a material or has a shape such that it can deform to a greater extent than the upper part when the powder explodes;

or the thickness of the lower part is less, with respect to the thickness of the upper part, or the materials the two parts are made of are different.

8. A method for manufacturing a shotshell according to claim 1, said method comprising the steps of:

a) preparing at least the following distinct and separate components of the shotshell: the hull, the powder, the sealing element, the inner tubular element open at both the ends thereof, the plurality of pellets;

b) initially inserting the powder from the upper opening of the outer tubular element of the hull;

c) then inserting from the upper opening of the outer tubular element of the hull the sealing element, which is pushed against the powder and at least one cylindrical portion of the outer side wall being in contact with a corresponding cylindrical portion of the inner side wall of said outer tubular element, d) then inserting the inner tubular element, with both ends thereof open, from the upper opening of the outer tubular element of the hull;

e) then inserting the plurality of pellets from the upper opening of the inner tubular element;

f) then closing the shotshell, wherein said wad is constructed during the construction of the shotshell by connecting together at least said sealing element and said inner tubular element inside said outer tubular element, wherein:

the sealing element and the inner tubular element of the wad, are inserted in the outer tubular element of the hull, so that the inner tubular element is without sealing elements therein, the sealing element adapted to isolate the gases developing from the explosion of the powder contained in the hull being provided in the shotshell only outside said inner tubular element; said sealing function being performed only by the contact: of at least one portion of an outer wall of the sealing element with a corresponding portion of the inner wall of the outer tubular element, and by the contact of at least one portion of the upper face of the sealing element with a lower edge of said inner tubular element;

only said sealing element, which always remains outside said inner tubular element, is inserted in the shotshell.

9. The method according to claim 8, further comprising the step of inserting the additional element inside the inner tubular element in a lower portion of said inner tubular element which extends from the lower opening towards the upper opening, wherein said additional element is provided below the plurality of pellets, wherein said additional element is adapted to: stiffen said lower portion of the inner tubular element or to at least partially absorb the resisting force generated by said plurality of pellets at the time of explosion of the powder and of the phase of pushing the wad, but not also to create a seal with said inner tubular element, that is to say that said additional element is not adapted to create a seal and isolate the inner tubular element from the gases developing from the explosion of the powder contained in the hull, from the inner tubular element and from what is contained therein, said sealing action being performed only by said sealing element, outside the inner tubular element.

* * * * *